US009201346B2

(12) United States Patent
Sako

(10) Patent No.: US 9,201,346 B2
(45) Date of Patent: Dec. 1, 2015

(54) POWDER TRANSPORT DEVICE, DEVELOPING DEVICE, AND IMAGE FORMING APPARATUS

(71) Applicant: FUJI XEROX CO., LTD., Tokyo (JP)

(72) Inventor: Kiyoshi Sako, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 16 days.

(21) Appl. No.: 14/030,508

(22) Filed: Sep. 18, 2013

(65) Prior Publication Data

US 2014/0294446 A1 Oct. 2, 2014

(30) Foreign Application Priority Data

Mar. 26, 2013 (JP) ..... 2013-064054

(51) Int. Cl.
*G03G 15/08* (2006.01)

(52) U.S. Cl.
CPC ..... *G03G 15/0891* (2013.01)

(58) Field of Classification Search
CPC ..... G03G 15/0865; G03G 15/0831; G03G 15/0891
USPC ..... 399/107, 111, 119, 222, 255, 256, 258
See application file for complete search history.

(56) References Cited

U.S. PATENT DOCUMENTS 5,510,882 A * 4/1996 Kikuta et al. ..... 399/257
6,421,516 B1 7/2002 Kinoshita et al.
2003/0175050 A1* 9/2003 Murayama et al. ..... 399/256
2006/0204283 A1* 9/2006 Yasuda ..... 399/254
2007/0242981 A1 10/2007 Hirota
2008/0124132 A1* 5/2008 Aimoto ..... 399/256
2008/0187332 A1* 8/2008 Tsuda et al. ..... 399/27
2008/0240775 A1* 10/2008 Mase ..... 399/111
2012/0114349 A1* 5/2012 Matsumoto et al. ..... 399/53
2013/0045029 A1* 2/2013 Kimura et al. ..... 399/272

FOREIGN PATENT DOCUMENTS

JP H02-63078 A 3/1990
JP 2001-092253 A 4/2001
JP A 2004-54096 2/2004

(Continued)

OTHER PUBLICATIONS

Aug. 25, 2015 Office Action issued in Japanese Application No. 2013-064054.

*Primary Examiner* — Francis Gray
(74) *Attorney, Agent, or Firm* — Oliff PLC

(57) ABSTRACT

A powder transport device includes a transport path having a supply port. Powder supplied through the supply port together with old powder already contained in the transport path is transported through the transport path. The powder transport device also includes a transport member, which is rotatably disposed in the transport path and includes a rotational shaft and a spiral blade disposed on the rotational shaft. The powder supplied through the supply port and the old powder are transported toward a downstream side in a powder transporting direction and mixed with each other by rotation of the transport member. The transport path includes a regulating portion regulating transportation of powder that is a mixture of the powder supplied through the supply port and the old powder toward the downstream side. The transport member includes an accumulation portion that opposes the regulating portion and causes the powder to accumulate.

12 Claims, 17 Drawing Sheets

(56) References Cited

FOREIGN PATENT DOCUMENTS

| | | |
|---|---|---|
| JP | A 2004-85877 | 3/2004 |
| JP | A 2004-198852 | 7/2004 |
| JP | 2005-321470 A | 11/2005 |
| JP | 2006-178381 A | 7/2006 |
| JP | 2007-286290 A | 11/2007 |
| JP | 2010-026487 A | 2/2010 |
| JP | A-2011-002863 | 1/2011 |

* cited by examiner

POWDER TRANSPORT DEVICE, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2013-064054 filed Mar. 26, 2013.

BACKGROUND (i) Technical Field

The present invention relates to a powder transport device, a developing device, and an image forming apparatus.

(ii) Related Art

Image forming apparatuses such as copiers and printers use developing devices that develop electrostatic latent images formed on photoconductors. In such a developing device, a developing roller is provided so as to oppose the photoconductor. For example, a two-component developer, which includes a carrier having magnetic properties and a toner generally formed of resin, is agitated by an agitating transport member and supplied from the supply transport member to the developing roller.

SUMMARY

According to an aspect of the present invention, a powder transport device includes a transport path that has a supply port. Powder supplied through the supply port together with old powder already contained in the transport path is transported through the transport path. The powder transport device also includes a transport member that includes a rotational shaft and a spiral blade which is disposed on the rotational shaft. The transport member is rotatably disposed in the transport path and rotated so as to transport the powder supplied through the supply port and the old powder toward a downstream side in a powder transporting direction while mixing the powder supplied through the supply port with the old powder. In the powder transport device, the transport path includes a regulating portion that regulates transportation of powder that is a mixture of the powder supplied through the supply port and the old powder toward the downstream side. In the powder transport device, the transport member includes an accumulation portion that causes the powder to accumulate, and the regulating portion opposes the accumulation portion.

BRIEF DESCRIPTION OF THE DRAWINGS

Exemplary embodiment of the present invention will be described in detail based on the following figures, wherein.

DETAILED DESCRIPTION

Exemplary Embodiment

An exemplary embodiment will be described below with reference to the drawings.

Figure 1:
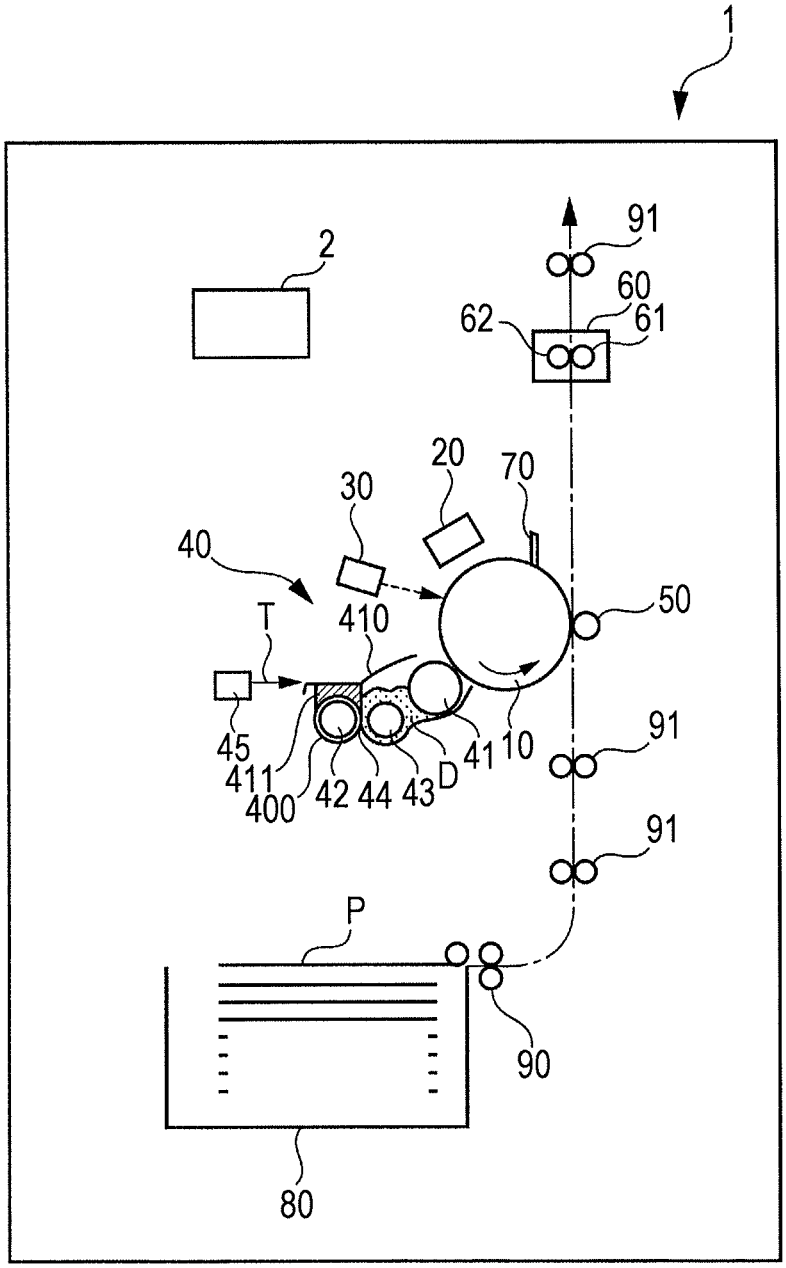
FIG. 1 is a general block diagram of an image forming apparatus according to an exemplary embodiment.

FIG. 1 is a general block diagram of an image forming apparatus 1 according to an exemplary embodiment. The image forming apparatus 1 according to the exemplary embodiment forms an image on, for example, paper P, which serves as an example of a recording medium, in accordance with image information supplied thereto. The image forming apparatus 1 includes a controller 2, a photoconductor 10, a charger 20, an exposure unit 30, a developing device 40, a transfer unit 50, a fixing unit 60, a cleaning unit 70, and a sheet container 80.

The controller 2 includes a computing unit such as a central processing unit (CPU) and a memory and controls operation of components of the image forming apparatus 1.

The photoconductor 10 is a cylindrical rotating body that includes a photosensitive layer formed of an organic photosensitive material that holds an image and rotated in a direction indicated by the solid arrow in FIG. 1. The photoconductor 10 extends in a depth direction with respect to the page of FIG. 1.

The charger 20 uses, for example, a charging roller or the like that rotates while being in contact with the surface of the photoconductor 10 so as to apply a predetermined charging voltage. The charger 20 may be of a contact charging type or a non-contact charging type. The contact charging type charger 20 is brought into contact with the photoconductor 10 so as to charge the photoconductor 10 by using a brush or the like. The non-contact charging type charger 20 charges the photoconductor 10 by utilizing corona discharge.

The exposure unit 30 irradiates the surface of the photoconductor 10, which has been charged by the charger 20, with light in accordance with image data so as to form an electrostatic latent image having a latent image potential in accordance with the potential difference. The electrostatic latent image is rotated to a position where the developing device 40 is disposed as the photoconductor 10 is rotated.

The developing device 40 includes a rotatable developing roller 41. Toner T attracted to the developing roller 41 is moved to the photoconductor 10. The toner T serves as an example of powder. The toner T is moved to the surface of the photoconductor 10 due to the potential difference between the electrostatic latent image formed on the photoconductor 10 and the charged toner T. In this way, a toner image is formed on the photoconductor 10. This toner image is moved to a position where the transfer unit 50 is disposed as the photoconductor 10 is rotated.

The developing device 40 also includes a developing container 400 and an upper lid 410. The developing container 400 includes therein an agitating transport member 42, a supply transport member 43, a separation wall 44, and a replenishment unit 45. The agitating transport member 42 serves as an example of a transport member that agitates a two-component developer (referred to as a developer D hereafter) that contains the toner T and a carrier. The supply transport member 43 supplies the developer D to the developing roller 41. The replenishment unit 45 replenishes the agitating transport member 42 with the toner T. The upper lid 410 has protrusions 411 that each serve as an example of a regulating portion that interferes with the flow of the toner T floating on the surface of the developer D.

The details of the developing device 40 is described below.

Figure 2:
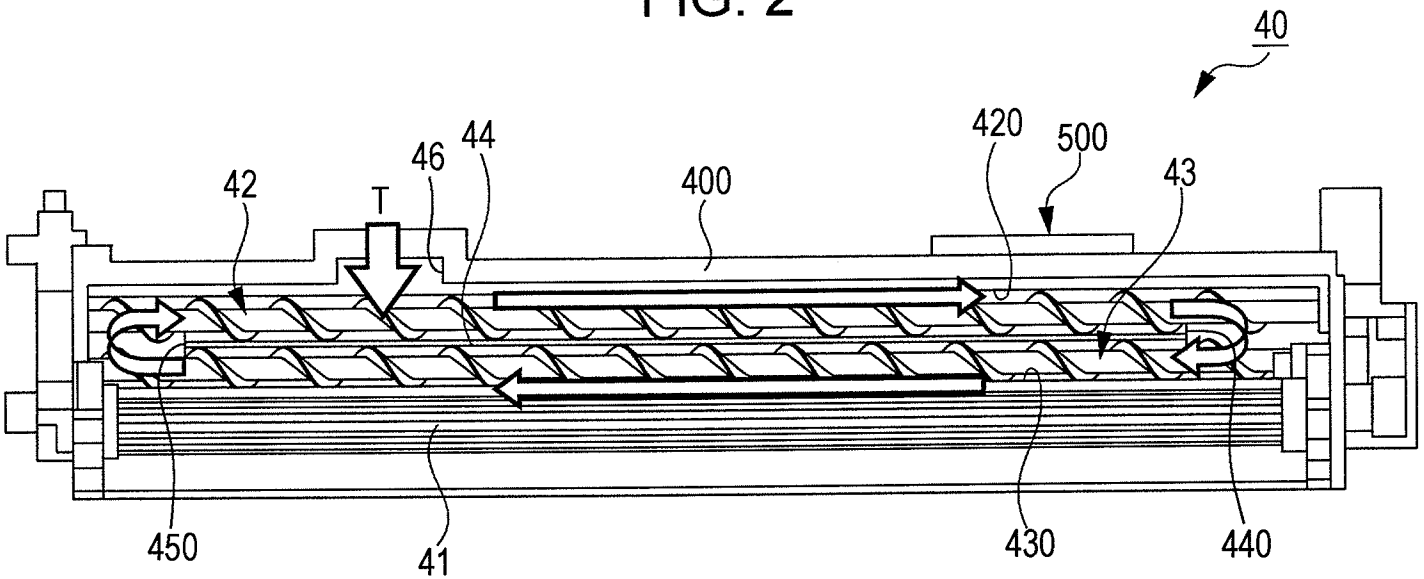
FIG. 2 is a plan view of a developing device with an upper lid removed.

FIG. 2 is a plan view of the developing device 40 with the upper lid 410 removed.

Referring to FIG. 2, the developing device 40 having a substantially rectangular shape in plan view extends in the depth direction of the image forming apparatus 1 so as to oppose the photoconductor 10 illustrated in FIG. 1.

The agitating transport member 42 and the supply transport member 43 are respectively disposed in an agitating transport path 420 and a supply transport path 430 formed in the developing container 400 with the separation wall 44 therebetween. The separation wall 44 has an opening 440 and an opening 450 formed at both ends thereof. The toner T is delivered from the agitating transport path 420 to the supply transport path 430 through the opening 440. The toner T is delivered from the supply transport path 430 to the agitating transport path 420 through the opening 450.

A toner supply port 46 that serves as an example of a supply port is provided at a position close to one end of the agitating transport path 420 between a central portion and the one end of the agitating transport path 420. The toner T is supplied from the replenishment unit 45 illustrated in FIG. 1 through the toner supply port 46. The toner T is supplied from the replenishment unit 45 to the developing device 40 through the toner supply port 46. The toner T newly supplied to the developing device 40 through the toner supply port 46 is referred to as new powder, and the developer D that is already contained in the developing device 40 before the new powder is supplied is referred to as old powder.

The developing roller 41 and the supply transport path 430 are disposed substantially parallel to each other.

The toner T supplied through the toner supply port 46 is agitated together with the developer D and transported by the agitating transport member 42 in the agitating transport path 420 in a direction indicated by the arrow in FIG. 2 while being mixed with the developer D. The new toner T is electrostatically charged by being agitated and mixed with the developer D and is electrostatically attracted to the carrier having magnetic properties. Hereafter, with respect to the toner T transport direction, a side from which the toner T is supplied is referred to as an upstream side and a side toward which the toner T is transported is referred to as a downstream side.

The developer D having been transported from the upstream side to the downstream side in the agitating transport path 420 is delivered to the supply transport path 430 through the opening 440. The developer D delivered to the supply transport path 430 is transported by the supply transport member 43 in the supply transport path 430 in the direction indicated by the arrow in FIG. 2. The toner T is attracted to the developing roller 41 while being transported in the supply transport path 430.

The developer D, the density of the toner T of which has been reduced because of the toner T being attracted to the developing roller 41, is delivered to the agitating transport path 420 through the opening 450 and transported by the agitating transport member 42 in the agitating transport path 420 toward the toner supply port 46. The developer D is again replenished with the toner T delivered through the toner supply port 46. In this way, the new powder is gradually supplied to the old powder, and the developer D is circulated in the developing container 400 in a path indicated by the arrows in FIG. 2.

A density sensor unit 500 is provided in the agitating transport path 420 of the developing container 400. The density sensor unit 500 serves as an example of a sensor that detects the density of the toner T. The density sensor is provided on the downstream side of the toner supply port 46 in the agitating transport path 420 at a position close to the other end of the agitating transport path 420, the other end located on a side opposite to the side where the toner supply port 46 is provided, between the central portion and the other end of the agitating transport path 420. It is desirable that the density sensor unit 500 be provided, as described above, on the downstream side of a position where the toner T as the new powder is mixed with the developer D as the old powder. Furthermore, by providing the density sensor unit 500 on the downstream side, the density of the toner T in the developer D before the toner T is attracted to the developing roller 41 is more accurately detected.

Figure 3:
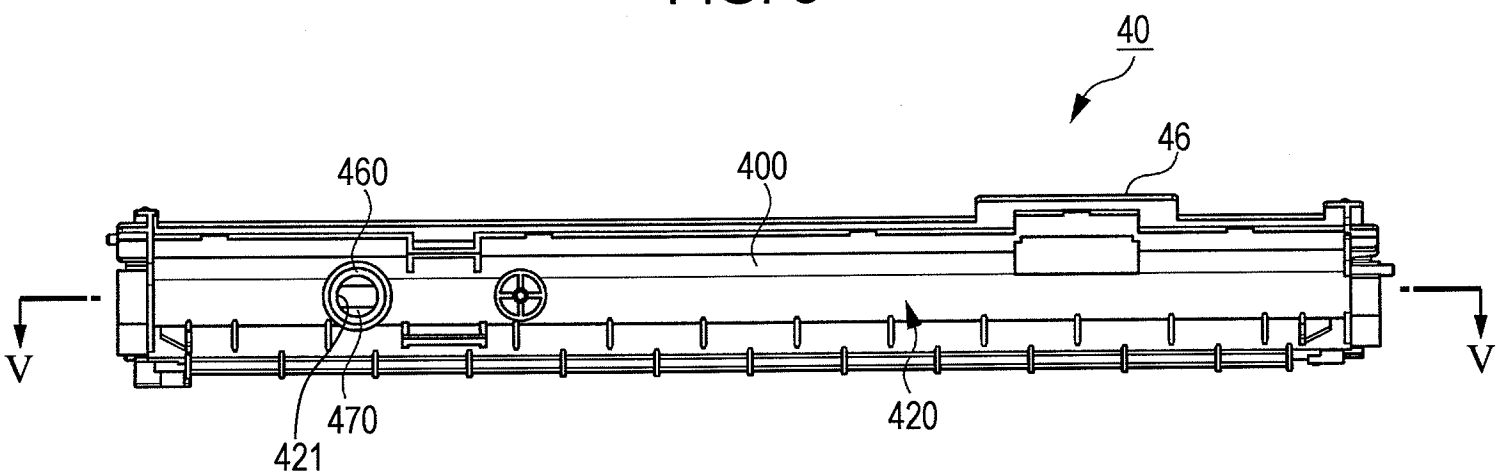
FIG. 3 is a front view of the developing device seen from an agitating transport path side.

FIG. 3 is a front view of the developing device 40 seen from the agitating transport path 420 side. Here, FIG. 3 illustrates the developing device 40 with the density sensor unit 500 removed.

In FIG. 3, an attachment portion 460, to which the density sensor unit 500 is attached, is formed in the developing container 400. The attachment of the density sensor unit 500 to the attachment portion 460 will be described in detail later.

The agitating transport member 42 and the agitating transport path 420 of the powder transport device are described in detail below.

Figure 4:
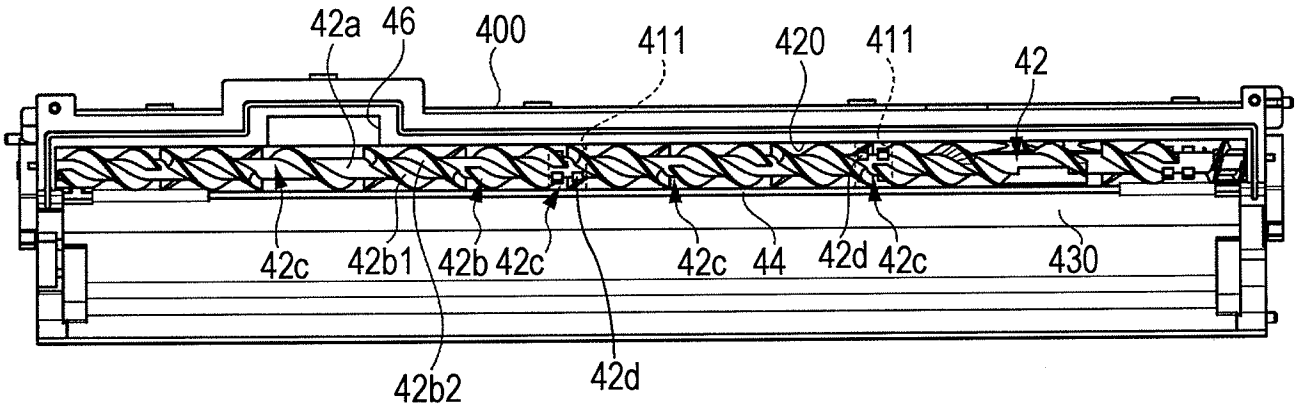
FIG. 4 is a plan view illustrating an agitating transport member, the agitating transport path, and so forth of a powder transport device.
Figure 5:
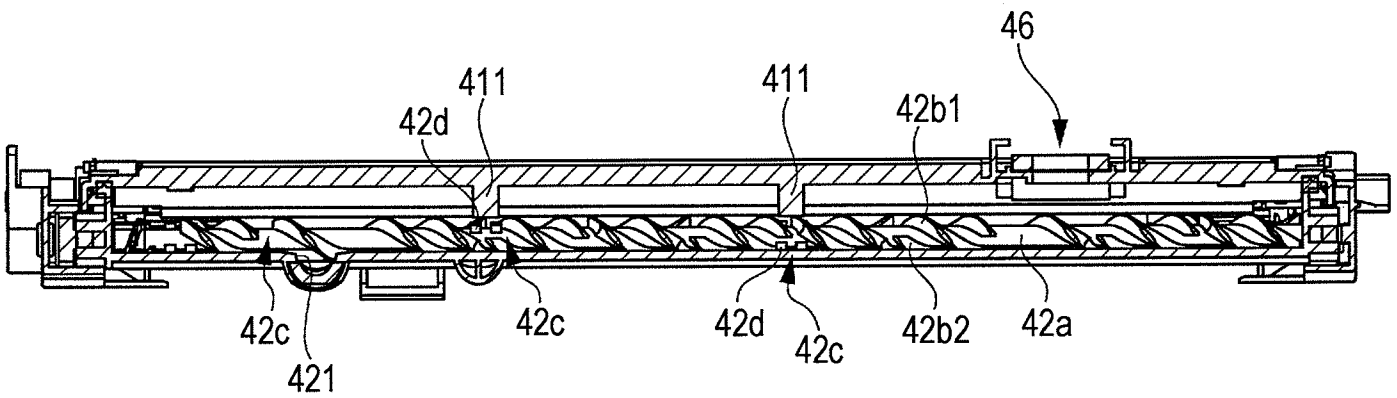
FIG. 5 illustrates an inclined section of the developing device taken along line V-V in FIG. 3.

FIG. 4 is a plan view illustrating the agitating transport member 42, the agitating transport path 420, and so forth of the powder transport device. FIG. 5 illustrates an inclined section of the developing device 40 illustrated in FIG. 3 taken along line V-V in FIG. 3. Here, the supply transport member 43 is omitted from FIG. 4.

Referring to FIG. 4, the agitating transport member 42 has a shaft 42*a* and a double-blade spiral blade 42*b*. The shaft 42*a* serves as an example of a rotational shaft. The double-blade spiral blade 42*b* has two spiral blades, which each serve as an example of a spiral blade, disposed on the shaft 42*a*. The double-blade spiral blade 42*b* has a spiral blade 42*b*1 and a spiral blade 42*b*2. In the double-blade spiral blade 42*b*, the spiral blade 42*b*1 and the spiral blade 42*b*2 are out of phase from each other by 180 degrees along the shaft 42.

The agitating transport member 42 is rotatably disposed in the agitating transport path 420.

The spiral blade 42b1 and the spiral blade 42b2 each have plural discontinued portions 42c, which are separated from one another by a phase of 360 degrees, so that portions of the spiral blade 42b1 and portions of the spiral blade 42b2 are respectively removed from the spiral blade 42b1 and the spiral blade 42b2 in the axis direction of the shaft 42a.

Referring to FIGS. 4 and 5, two protrusions 411, one of which is illustrated in FIG. 1, are spaced apart from each other so as to oppose the discontinued portions 42c. In FIG. 4, the protrusions 411 are illustrated by dashed lines. With the portions of the spiral blade 42b1 and the portions of the spiral blade 42b2 removed, the transport capacity of the discontinued portions 42c for transporting the developer D is reduced on the upstream and downstream sides of the discontinued portions 42c. This causes the developer D to accumulate at the discontinued portions 42c. The protrusions 411 provided along the spiral blade 42b1 and the spiral blade 42b1 interfere with the flow of the developer D. Thus, the developer D further accumulates.

Furthermore, by providing the plural protrusions 411, even when the position of the surface of the developer D varies in the up-down direction in the transport direction, any of the protrusions 411 may interfere with the flow of the toner T that floats on the surface of the developer D. The agitating transport path 420 is filled with the developer D to the degree by which the spiral blade 42b1 and the spiral blade 42b2 are buried in the developer D.

The toner T as the new powder is supplied to the surface of the developer D, which is the old powder, from above. Since there is a large difference in the specific gravity between the toner T and the developer D, in the case where the toner T and the developer D are not mixed with each other, the toner T is transported to the downstream side while floating on the surface of the developer D. In this case, the toner T is not necessarily correctly charged, and as a result, there may be defects such as defective images.

Figure 6:
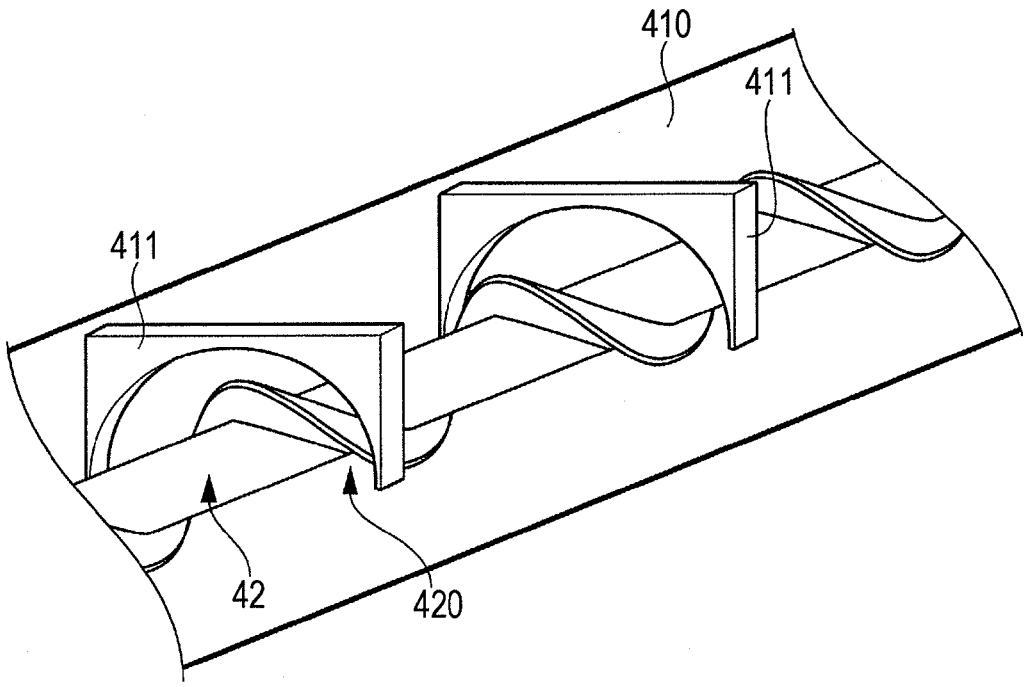
FIG. 6 is a schematic diagram illustrating the shape of protrusions.

FIG. 6 is a schematic diagram illustrating the shape of the protrusions 411. Each protrusion 411 has a tunnel shape such that the protrusion 411 covers the agitating transport member 42 along an arc shape conforming to the outer circumference of the shaft 42a while the protrusion 411 is not in contact with the agitating transport member 42. Thus, in the agitating transport path 420, the space between the agitating transport member 42 and the protrusions 411 is small. When the toner T floats on the surface of the developer D, the toner T is blocked by the protrusions 411.

Referring to FIGS. 4 and 5, four plate members 42d, which each serve as an example of an agitating blade, are provided in each of the discontinued portions 42c of the shaft 42a opposing a corresponding one of the protrusions 411 so as to correspond to the protrusion 411. The plate members 42d protrude from the shaft 42a such that the large surface of each plate member 42d is parallel to the rotational direction side of the shaft 42a. The plate members 42d are arranged such that a pair of two plate members 42d are disposed side by side in the shaft 42a direction, and the other pair of plate members 42d are disposed on the opposite side of the shaft 42a with the shaft 42a interposed therebetween. The surfaces of the plate members 42d may be slightly inclined to face the upstream or downstream side.

When the shaft 42a is rotated, the plate members 42d cause the toner T blocked by the protrusions 411 in the discontinued portions 42c to move in the rotational direction, thereby applying forces by which the developer D is involved in the rotation to the developer D. With these forces, the toner T blocked by the protrusions 411 is mixed with the developer D.

In the above description, the double-blade spiral blade having the discontinued portions 42c is used. However, a single-blade spiral blade may be used or a continuous spiral blade without the discontinued portions 42c may be used. It is desirable that the plate members 42d be provided on the shaft 42a at positions opposing the protrusions 411.

The density sensor unit 500 is described in detail below.

The density sensor unit 500 detects the density of the toner T in the developer D.

Figure 7:
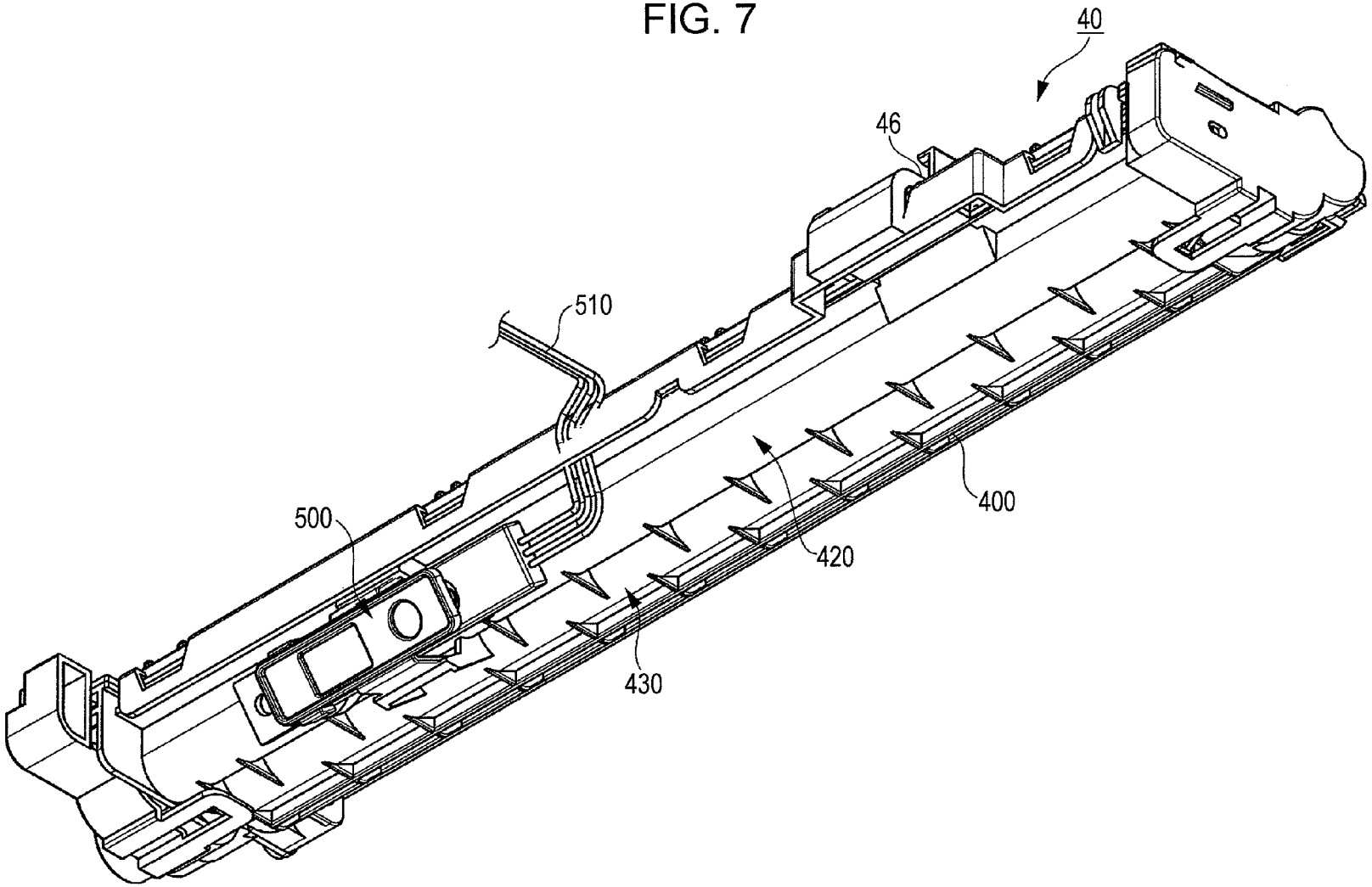
FIG. 7 is a perspective view of the developing device seen from a density sensor unit side.

FIG. 7 is a perspective view of the developing device 40 seen from the density sensor unit 500 side illustrating the density sensor unit 500 attached to the developing container 400 illustrated in FIG. 3.

Figure 8:
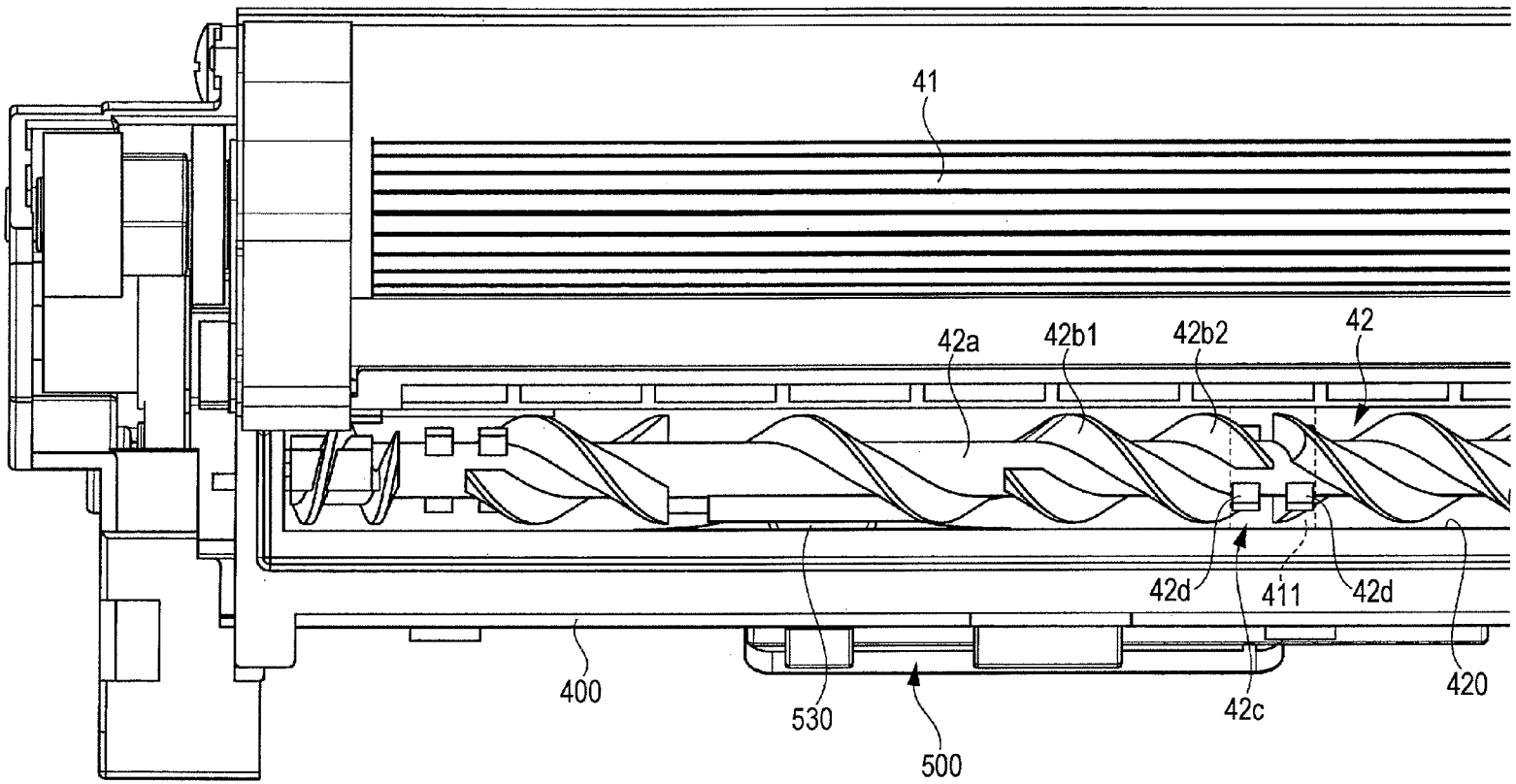
FIG. 8 is an enlarged plan view illustrating the density sensor unit and a region around the density sensor unit.
Figure 9:
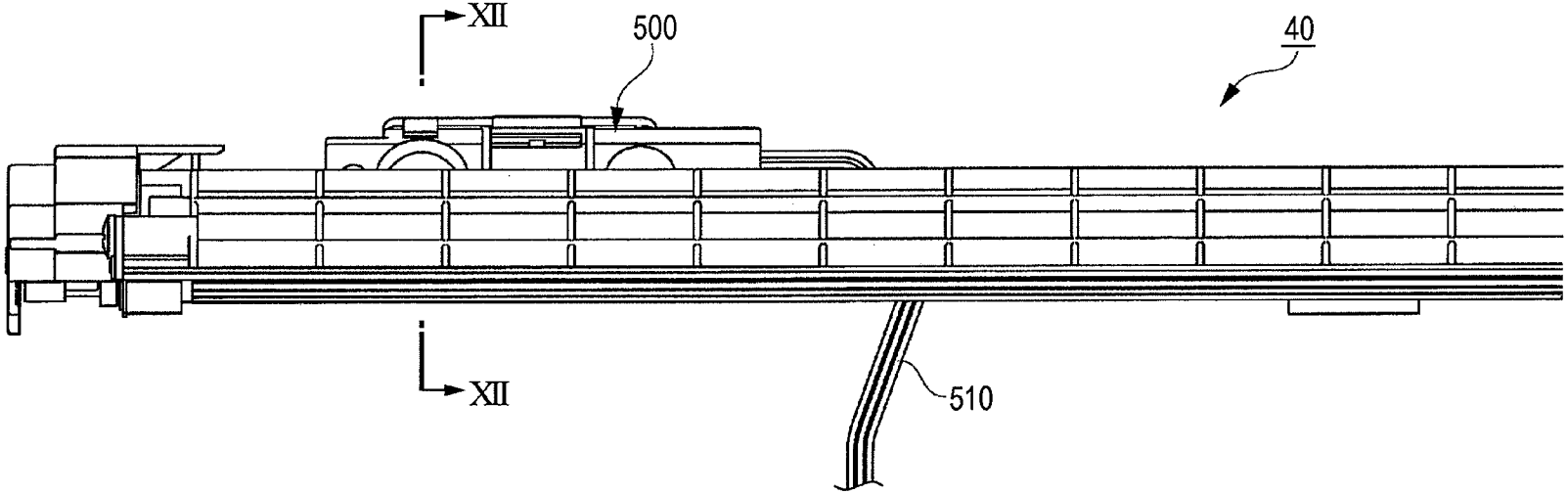
FIG. 9 is a rear view illustrating the density sensor unit and a region around the density sensor unit.
Figure 10:
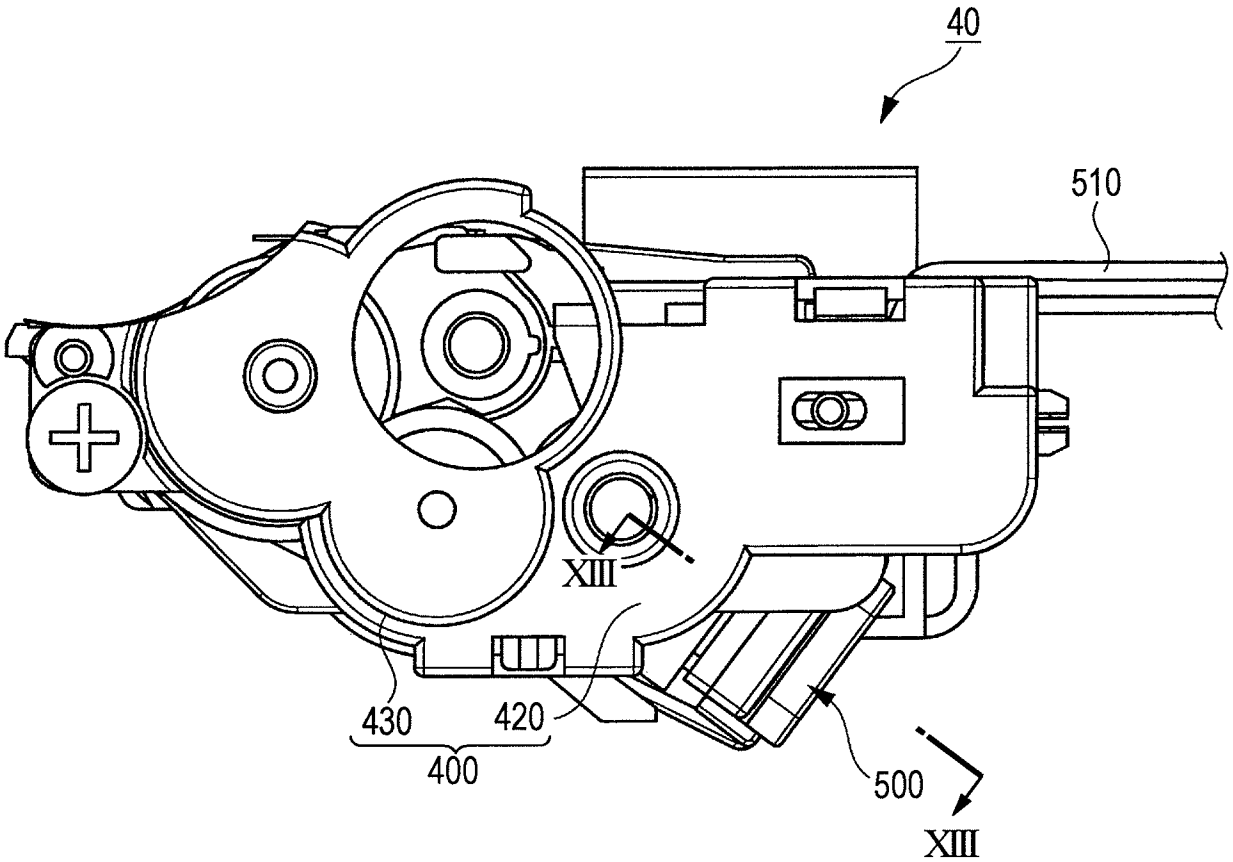
FIG. 10 is a side view illustrating the density sensor unit and a region around the density sensor unit.
Figure 11:
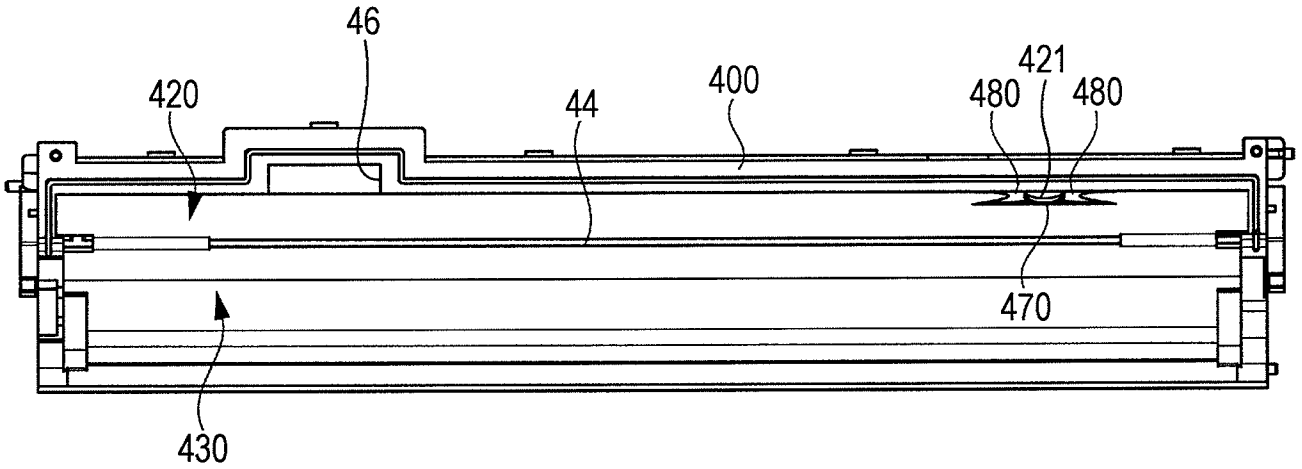
FIG. 11 is a plan view illustrating a developing container.

FIG. 8 is an enlarged plan view illustrating the density sensor unit 500 and a region around the density sensor unit 500. FIG. 9 is a rear view illustrating part of the developing device 40. FIG. 10 is a side view illustrating the developing device 40. FIG. 11 is a plan view illustrating the developing container 400.

Figure 12:
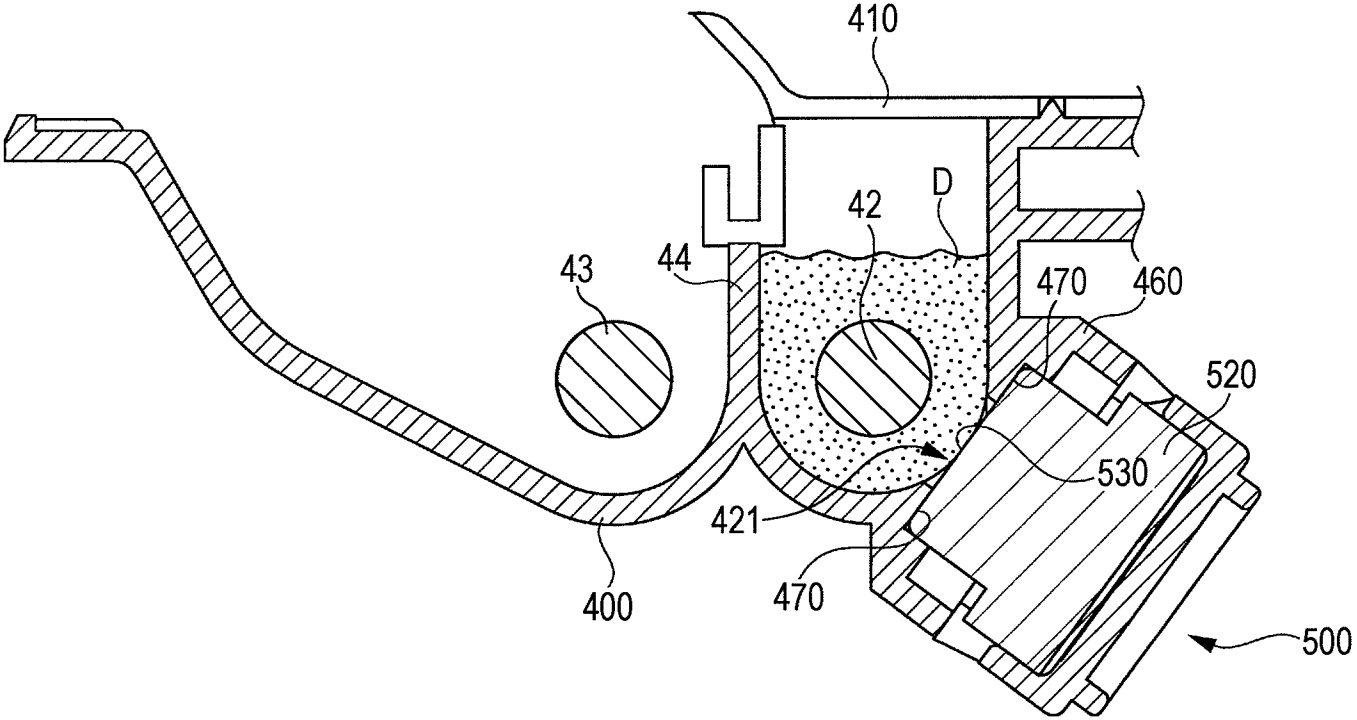
FIG. 12 is a sectional view of the density sensor unit taken along line XII-XII in FIG. 9.
Figure 13:
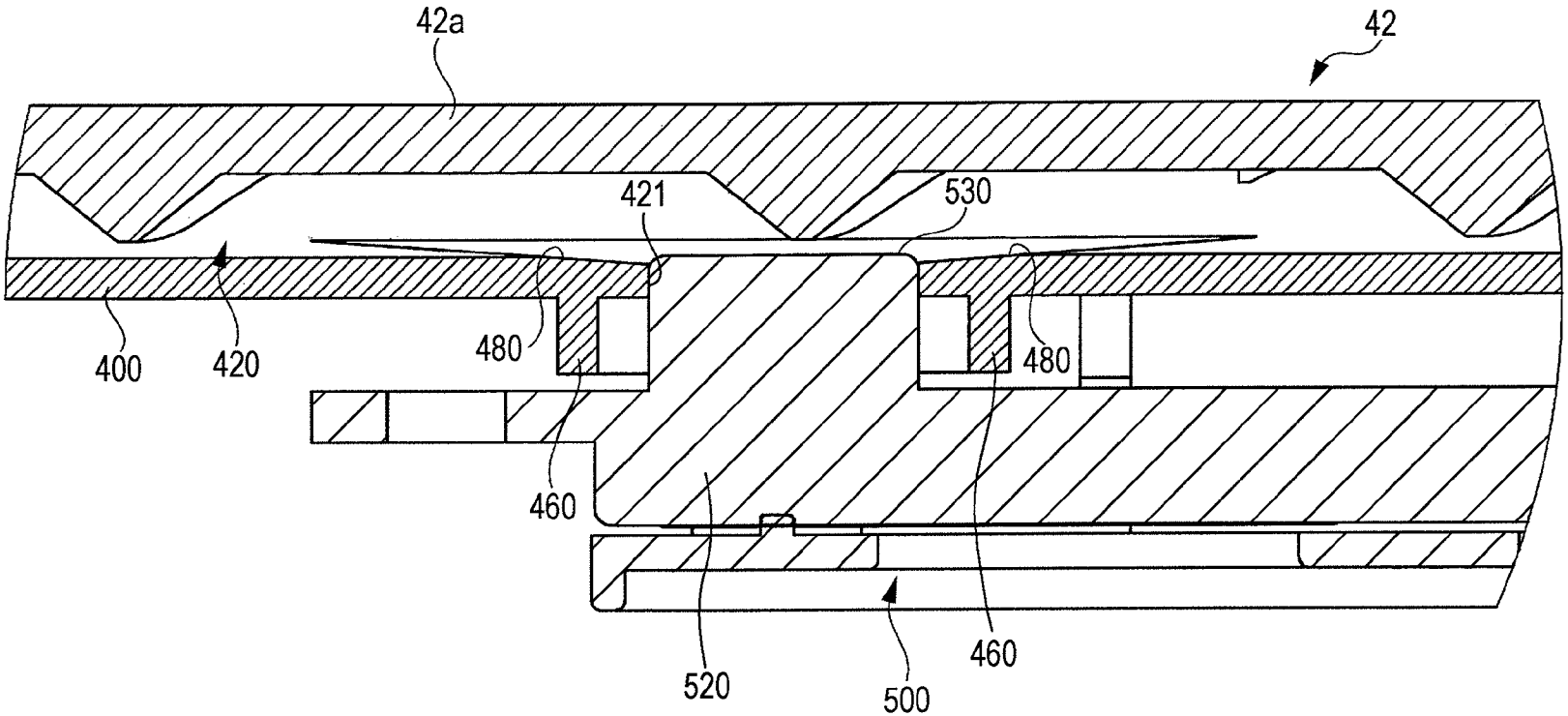
FIG. 13 is a sectional view of the density sensor unit and a region around the density sensor unit taken along line XIII-XIII in FIG. 10.

FIG. 12 is a sectional view taken along line XII-XII in FIG. 9. FIG. 13 is a sectional view of the density sensor unit 500 and a region around the density sensor unit 500 taken along line XIII-XIII in FIG. 10.

Referring to FIGS. 7, 8, 9, and 10, the density sensor unit 500 is attached to a wall that forms the agitating transport path 420 of the developing container 400. A signal cable 510 for inputting and outputting signals is connected to the density sensor unit 500.

Referring to FIGS. 3, 11, and 12, the cylindrical attachment portion 460 is formed in the developing container 400. A sensor body 520 having a cylindrical column shape of the density sensor unit 500 is pressed into the attachment portion 460. In the developing container 400 having the attachment portion 460, an opening 421 is formed on the inner side of the attachment portion 460. When the sensor body 520 is attached to the attachment portion 460, an end surface 530 of the sensor body 520 is exposed from the opening 421, so that the end surface 530 is brought into contact with the developer D being transported.

Furthermore, in comparison with the diameter of the end surface 530 of the sensor body 520, the cylindrical surface of the agitating transport path 420 has a smaller curvature. Thus, the opening 421 has a substantially elliptical shape having the major axis in the developer D transport direction.

Referring to FIG. 12, the end surface 530 of the sensor body 520 is pressed against and secured to a wall 470 of the developing container 400 from the outer side of the developing container 400. The wall 470 is formed in the minor axis direction of the elliptical (see FIG. 11) opening 421. Since the end surface 530 of the sensor body 520 is pressed against and secured to the wall 470, manufacture variation of the gap between the agitating transport member 42 and the end surface 530 of the sensor body 520 is reduced.

Furthermore, since the sensor body 520 is pressed into the cylindrical attachment portion 460 and the end surface 530 thereof is pressed against and secured to the wall 470 of the developing container 400 from the outer side of the developing container 400, leaking of the developer D through a portion where the sensor body 520 is attached is suppressed.

Furthermore, referring to FIGS. 11 and 13, in the inner surface of the developing container 400 in which the agitating transport path 420 having the opening 421 is formed, inclinations 480 are formed so as to be arranged on both the upstream and downstream sides in the developer D transport direction. With the inclinations 480, the developer D is reliably brought into contact with the end surface 530 of the sensor body 520. This improves the detection accuracy.

Furthermore, the start position of the inclination 480 on the upstream side is disposed at a position shifted from the discontinued portions 42*c* of the spiral blades 42*b*1 and 42*b*2. By shifting from the discontinued portions 42*c*, accumulation of the developer D is suppressed.

The transfer unit 50 transfers the toner image formed on the photoconductor 10 onto the paper P having been transported by transport rollers 91. The paper P, onto which the toner image has been transferred, is transported to the fixing unit 60 by the transport roller 91.

The fixing unit 60 includes a fixing roller 61 and a pressure roller 62. The fixing roller 61 serves as an example of a pressure receiving body that includes a heat source. The pressure roller 62 opposes the fixing roller 61. An unfixed toner image formed on the paper P is heated and subjected to pressure so as to be fixed. The paper P, onto which the toner image has been fixed by the fixing unit 60, is transported by the transport roller 91 and contained.

The cleaning unit 70 removes the toner and the like remaining on the surface of the photoconductor 10 after the toner image has been transferred onto the paper P. The sheet container 80 contains plural sheets of the paper P. A sheet of the paper P is picked up from the sheet container 80 by a sheet feed roller 90 and transported to the transfer unit 50 by the transport rollers 91.

With the image forming apparatus 1 equipped with the developing device 40, the agitating performance with which the developer D and the toner T are agitated is improved, the toner T is adequately charged, and an image without streaks, non-uniform density, and the like is obtained.

The position and shape of the protrusion 411 described in the exemplary embodiment are not limited to those of the exemplary embodiment. Modifications of the exemplary embodiment are described below. The same elements as in the exemplary embodiment are denoted by the same reference numerals.

First Modification

Figure 14A:
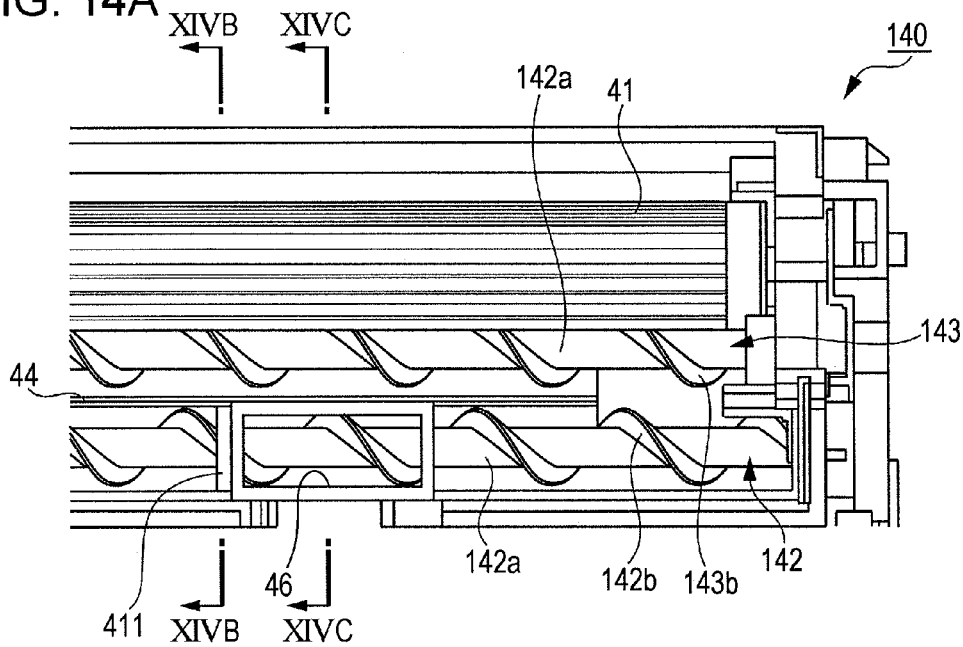
FIG. 14A is a plan view illustrating a toner supply port and a region around the toner supply port of a developing device of a first modification.
Figure 14B:
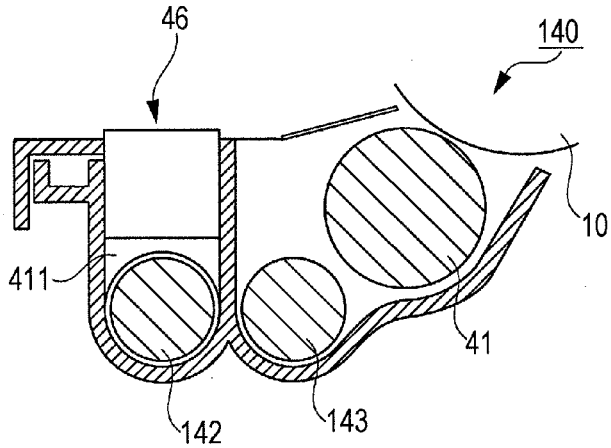
FIG. 14B is a sectional view taken along line XIVB-XIVB in FIG. 14A.
Figure 14C:
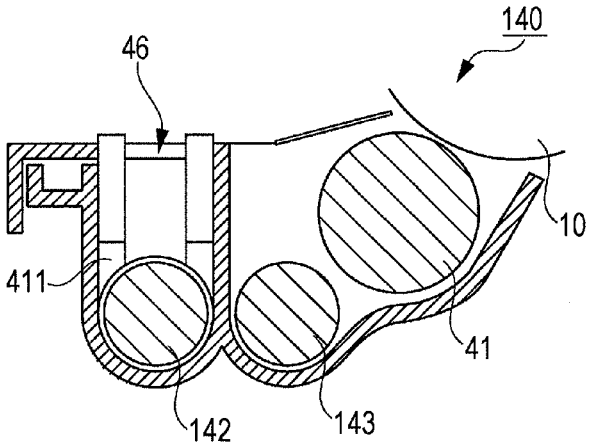
FIG. 14C is a sectional view taken along line XIVC-XIVC in FIG. 14A.

FIG. 14A is a plan view illustrating the toner supply port 46 and a region around the toner supply port 46 of a developing device 140 of a first modification. FIG. 14B is a sectional view taken along line XIVB-XIVB in FIG. 14A, and FIG. 14C is a sectional view taken along line XIVC-XIVC in FIG. 14A. In the first modification, the position of the protrusion 411 and the shape of the transport member are different from those of the exemplary embodiment.

Referring to FIGS. 14A to 14C, the developing device 140 includes an agitating transport member 142 and a supply transport member 143. The agitating transport member 142 and the supply transport member 143 respectively include spiral blades 142*b* and 143*b*, which each include a single blade disposed on a shaft 142*a* without discontinued portions. Here, one of the spiral blades 142*b* and 143*b* may have a double-blade spiral blade similar to that of the exemplary embodiment.

In the present modification, the protrusion 411 is continuous with the toner supply port 46 on the downstream side of the toner supply port 46. Toner supplied through the toner supply port 46 is blocked by the protrusion 411, moved downward from the toner supply port 46, and transported.

Second Modification

Figure 15A:
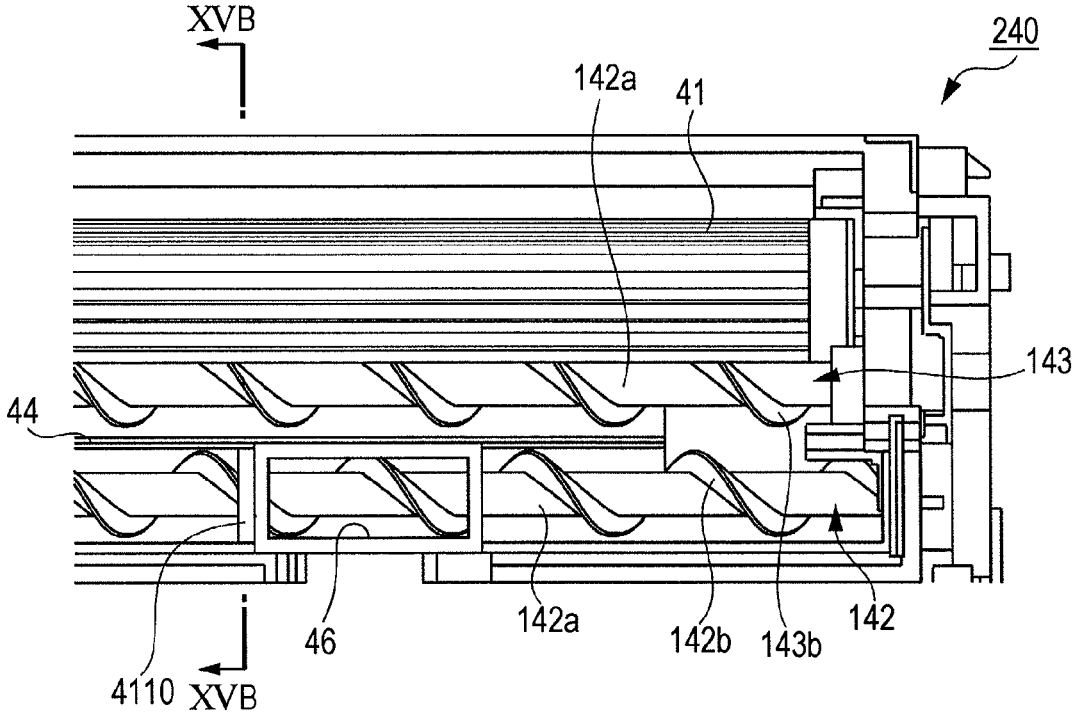
FIG. 15A is a plan view illustrating a toner supply port and a region around the toner supply port of a developing device of a second modification.
Figure 15B:
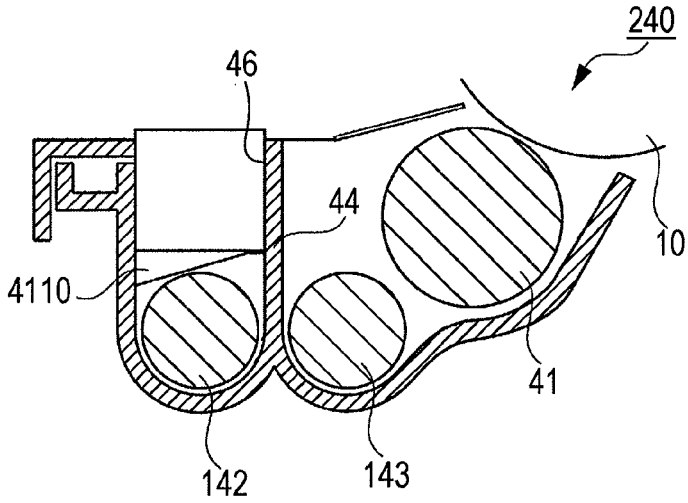
FIG. 15B is a sectional view taken along line XVB-XVB in FIG. 15A.

FIG. 15A is a plan view illustrating the toner supply port 46 and a region around the toner supply port 46 of a developing device 240 of a second modification. FIG. 15B is a sectional view taken along line XVB-XVB in FIG. 15A. In the second modification, the shape of the protrusion 411 is different from that of the first modification.

A protrusion 4110 of the present modification has an inclination at its end. The end of the protrusion 4110 may be inclined downward toward the agitating transport member 142 side or the supply transport member 143 side.

With the inclination of the protrusion 4110, a flow of the developer D is produced in the toner supply port 46. When the flow is produced in the toner supply port 46, the toner is broken up in the toner supply port 46, and accordingly, the toner is efficiently supplied to the developer D.

Third Modification

Figure 16A:
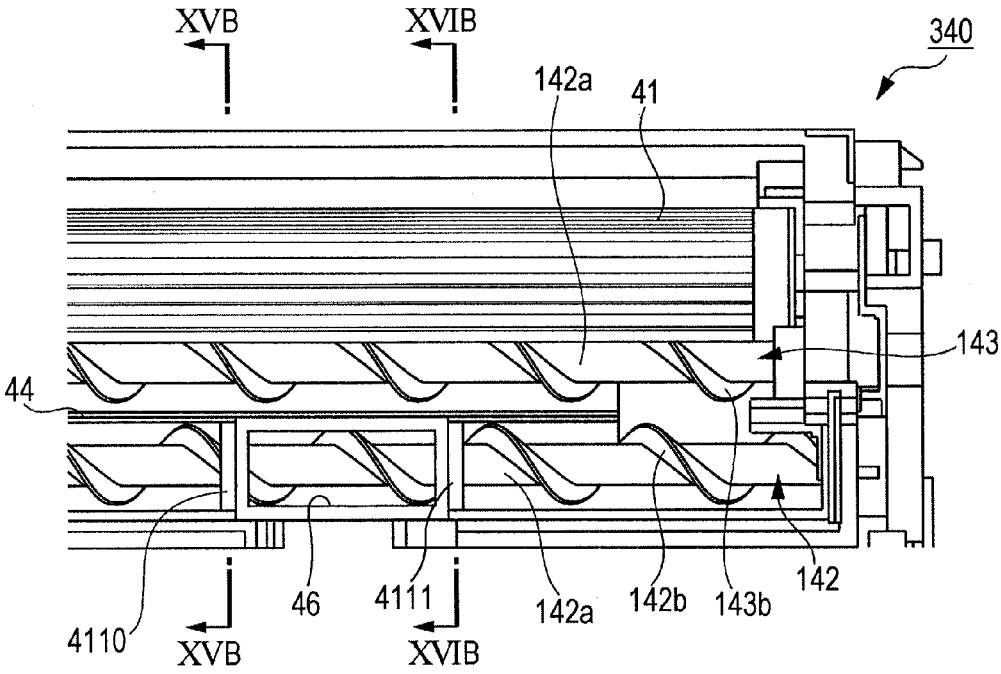
FIG. 16A is a plan view illustrating a toner supply port and a region around the toner supply port of a developing device of a third modification.
Figure 16B:
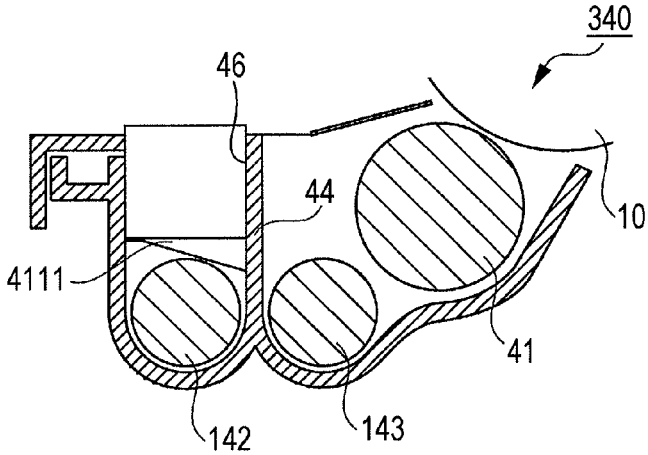
FIG. 16B is a sectional view taken along line XVIB-XVIB in FIG. 16A.

FIG. 16A is a plan view illustrating the toner supply port 46 and a region around the toner supply port 46 of a developing device 340 of a third modification. FIG. 16B is a sectional view taken along line XVIB-XVIB in FIG. 16A. A sectional view taken along line XVB-XVB is the same as the FIG. 15B. The difference between the second and the third modifications is that, in the third modification, a protrusion 4111 is added.

The protrusion 4111 is provided on a side of the toner supply port 46 opposite to the side of the toner supply port 46 where the protrusion 4110 is provided in the second modification. The end of the protrusion 4111 is inclined downward toward the side opposite to the side toward which the protrusion 4110 of the second modification is inclined downward.

With the protrusions 4110 and 4111, which are inclined toward the directions opposite to each other, on both sides of the toner supply port 46, an additional flow of the developer D is produced in the toner supply port 46. When the additional flow of the toner is produced in the toner supply port 46, the toner in the toner supply port 46 is more easily broken up. Thus, the developer D is more efficiently supplied.

Fourth Modification

Figure 17:
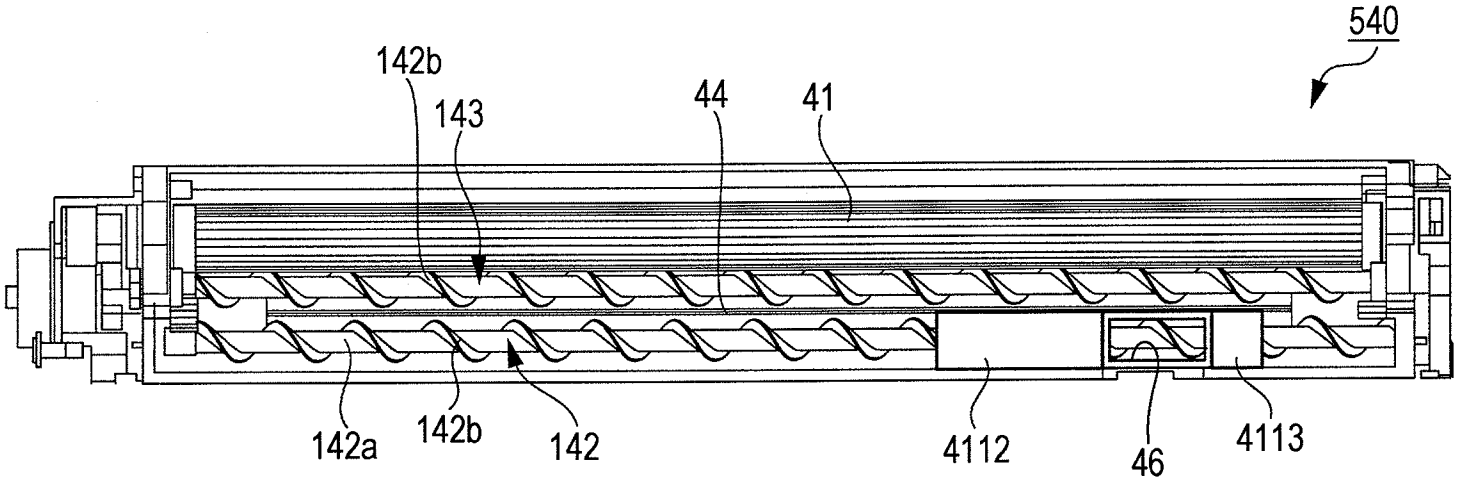
FIG. 17 is a plan view illustrating a developing device of a fourth modification.

FIG. 17 is a plan view illustrating a developing device 540 of a fourth modification. In comparison with the exemplary embodiment and the other modifications, in the fourth modification, the lengths of the protrusions in the transport direction are increased.

In the present modification, protrusions 4112 and 4113 are provided on the downstream and upstream sides of the toner supply port 46, respectively.

In the present modification, the lengths of the protrusions 4112 and 4113 in the transport direction are increased, thereby more easily blocking the developer D.

Furthermore, since the protrusion on the upstream side is provided, the movement of the toner suspended in air toward the upstream side is suppressed. This may suppress leaking or the like of the toner in the device.

The shape of the regulating portion is not limited and may be alternatively a shape other than those of the protrusions described in the exemplary embodiment and the modifications as long as the regulating portion interferes with the flow of the powder floating on the surface of the developer D. The regulating portion is not necessarily formed in the upper lid. For example, the regulating portion may be formed on the side surface of the agitating transport path 420.

As the length of the protrusion in the transport direction is increased, the developer D is well agitated. However, in this case, the flow of the developer D is out of balance. Thus, the protrusion may include plural protrusions with a gap or gaps formed therebetween.

The following structure may be added to the structures of the aforementioned exemplary embodiment and the modifications. All the following structures accumulate the developer D by a regulating portion. Specifically, when any of the following structures is provided on the upstream side of the regulating portion, the transport speed of the developer D is reduced.

For example, the outer diameter of the spiral blade is reduced, pitch of the turns of the spiral blade is reduced, or the diameter of the rotational shaft is increased.

In the exemplary embodiment and the modifications, the toner T as a powder and the developer D as a powder are described. However, the technology described in the exemplary embodiment may be applicable to a variety of apparatuses in which new powder and old powder are transported while being agitated. For example, the technology described herein may be applicable to devices such as a developing device in which new toner and old toner are mixed with one another in a one-component developer method.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder transport device comprising:

a transport path that has a supply port, powder supplied through the supply port together with old powder already contained in the transport path being transported through the transport path; and a transport member that comprises a rotational shaft and a spiral blade, the spiral blade being disposed on the rotational shaft, the transport member being rotatably disposed in the transport path, the transport member being rotated so as to transport the powder supplied through the supply port and the old powder toward a downstream side in a powder transporting direction while mixing the powder supplied through the supply port with the old powder, the transport path comprising a regulating portion that regulates transportation of powder that is a mixture of the powder supplied through the supply port and the old powder toward the downstream side, the regulating portion regulating the powder from a surface of the powder, and the transport member comprising an accumulation portion that causes the powder to accumulate; and a sensor disposed on the downstream side of the supply port in the powder transporting direction, the sensor detecting a density of the powder, the regulating portion opposing the accumulation portion, and the regulating portion being formed between the supply port and the sensor.

2. The powder transport device according to claim 1, wherein the accumulation portion is an agitating blade formed on the rotational shaft at a position that opposes the regulating portion.

3. The powder transport device according to claim 2, wherein the agitating blade is a protrusion formed on the rotational shaft, and the protrusion has a surface that opposes a rotational direction of the rotational shaft.

4. The powder transport device according to claim 1, wherein the accumulation portion is formed by a discontinued portion of the spiral blade.

5. The powder transport device according to claim 1, wherein the regulating portion is formed in the transport path so as to be continuous with the supply port.

6. The powder transport device according to claim 1, wherein the regulating portion is formed on an upstream side of the supply port in the powder transporting direction.

7. A developing device comprising:

the powder transport device according to claim 1, wherein an image is developed with the powder transported through the transport path.

8. An image forming apparatus comprising:

the powder transport device according to claim 1, wherein an image is formed on a recording medium with the powder transported through the transport path.

9. An image forming apparatus comprising:

the developing device according to claim 7, wherein an image developed by the developing device is formed on a recording medium.

10. The powder transport device according to claim 1, the accumulation portion being disposed on the rotational shaft of the transport member in between a discontinued portion defined in the spiral blade.

11. The powder transport device according to claim 1, wherein the regulation portion protrudes from the upper surface of the transport path.

12. A powder transport device comprising:

a transport path that has a supply port, powder supplied through the supply port together with old powder already contained in the sport path being transported through the transport path; and a transport member that comprises a rotational shaft and a spiral blade, the spiral blade being disposed on the rotational shaft, the transport member being rotatably disposed in the transport path, the transport member being rotated so as to transport the powder supplied through the supply port and the old powder toward a downstream side in a powder transporting direction while mixing the powder supplied through the supply port with the old powder, the transport path comprising a regulating portion that regulates transportation of powder that is a mixture of the powder supplied through the supply port and the old powder toward the downstream side, the regulating portion regulating the powder from a surface of the powder, the transport member comprising an accumulation portion that causes the powder to accumulate, the regulating portion opposing the accumulation portion, and the regulating portion covering the transport member along an arc shape conforming to the outer circumference of the shaft.

* * * * *